US006066014A

United States Patent [19]

Smith et al.

[11] Patent Number: 6,066,014

[45] Date of Patent: May 23, 2000

[54] SMALL WATERCRAFT EXHAUST DEVICE

[75] Inventors: Steven George Smith, Cushing, Wis.; Dallas Beckwith Wynne, Spirit Lake, Iowa

[73] Assignee: Polaris Industries Inc., Minneapolis, Minn.

[21] Appl. No.: 09/135,076

[22] Filed: Aug. 17, 1998

[51] Int. Cl.[7] ..... B63H 21/32

[52] U.S. Cl. ..... 440/89; 114/55.5; 114/55.57

[58] Field of Search ..... 440/89; 114/382, 114/55.5, 55.51, 55.52, 55.53, 55.54, 55.55, 55.56, 55.57, 55.58

[56] References Cited

U.S. PATENT DOCUMENTS

| | | | |
|---|---|---|---|
| Re. 33,488 | 12/1990 | Kobayashi | 440/47 |
| D. 380,437 | 7/1997 | Saulters | D12/307 |
| 4,509,927 | 4/1985 | Ikeda | 440/89 |
| 4,643,685 | 2/1987 | Nishida | 440/42 |
| 4,824,409 | 4/1989 | Kobayashi | 440/47 |
| 4,932,347 | 6/1990 | Mardikian | 114/55.52 |
| 4,989,409 | 2/1991 | Nakase et al. | 60/321 |
| 5,234,364 | 8/1993 | Ito | 440/89 |
| 5,389,022 | 2/1995 | Kobayashi | 440/89 |
| 5,490,474 | 2/1996 | Ikeda | 440/89 |
| 5,511,505 | 4/1996 | Kobayaski et al. | 440/89 |
| 5,536,189 | 7/1996 | Mineo | 440/89 |
| 5,556,314 | 9/1996 | Fukuda et al. | 440/89 |
| 5,572,943 | 11/1996 | Kobayashi et al. | 114/270 |
| 5,676,575 | 10/1997 | Fukuda et al. | 440/89 |

*Primary Examiner*—S. Joseph Morano
*Assistant Examiner*—Lars A. Olson
*Attorney, Agent, or Firm*—Fredrikson & Byron, P.A.

[57] ABSTRACT

A personal watercraft having a hull with a plurality of strakes and an inboard internal combustion engine which powers a jet-pump propulsion drive for propelling the watercraft through a body of water. The watercraft includes an exhaust system, that is in fluid communication with the engine, which terminates at a number of rearwardly facing exhaust outlets. Each of the outlets is positioned in the hull adjoining one of the strakes' rearward end, thus being located below the water's surface when the hull is in its normal upright position.

9 Claims, 4 Drawing Sheets

SMALL WATERCRAFT EXHAUST DEVICE

FIELD OF THE INVENTION

The present invention generally relates to motorized personal watercraft, and more particularly to an improved exhaust design for use in such watercraft.

BACKGROUND OF THE INVENTION

There is a particularly popular type of small watercraft which is known as a "personal watercraft." This type of watercraft is a type in which one or more passengers ride on, rather than in, the watercraft. The personal watercraft is characterized by having a pair of handlebars, and straddle-type seat disposed generally above the engine. These watercraft are primarily recreational in nature. Generally, this type of watercraft is powered by a jet propulsion drive unit (sometimes called a jet-pump) which is positioned in a tunnel formed on the underside of the hull. This type of watercraft is quite compact in its nature.

In connection with these types of watercraft, problems have been encountered in connection with the treatment of the exhaust gases. Particularly, it is important to provide an efficient discharge for the exhaust gases that will not create excess back pressure which can deteriorate engine performance, but effective silencing also must be accomplished.

Several types of exhaust treatment have been proposed for discharge and silencing of exhaust gases from jet propelled watercraft. In one of these types of systems the exhaust gases flow through one or more expansion chambers that are contained within the hull of the watercraft, the gases then being discharged through the side of the hull. This type of arrangement, however, does not always provide effective silencing.

Another type of exhaust system for jet propulsion powered watercraft discharges the exhaust gases either into the tunnel in which the jet propulsion unit is contained, or into the water being discharged from the discharge nozzle of the jet propulsion unit. This arrangement has also failed to be fully effective in exhaust silencing.

Yet another type of exhaust system is silenced by discharging the exhaust gases through an underwater exhaust gas outlet. However, this method of silencing has certain disadvantages caused primarily by the different speeds at which the watercraft may operate. For example, if the exhaust gases are discharged into the water at a level that is only slightly submerged when the watercraft is operating at low speeds, then the discharge may be too high and above the water when the watercraft is operating at high speeds. Alternatively, a lower discharge level, keeping it submerged at high speeds, may give rise to excessive back pressure of the exhaust gases when the watercraft is operating at low speeds.

Given the limitations of prior exhaust treatment designs it would be desirable to design an exhaust treatment system which used the efficient cooling of the surrounding water without reducing engine efficiency by high back pressures. The design and positioning of the exhaust outlets as found in the present invention provide such a solution.

SUMMARY OF THE INVENTION

One embodiment of the present invention is a personal watercraft which has a hull having a plurality of elongated strakes and an inboard internal combustion engine which powers a jet-pump type propulsion drive for propelling the watercraft through a body of water. The watercraft also has an exhaust system, in fluid communication with the engine, which terminates at a number of rearwardly facing exhaust outlets. Each of the outlets are positioned in the hull below the water's surface when the hull is in its normal upright position. Each outlet is also positioned adjoining a rearward end of one of the strakes. In another embodiment the watercraft has two exhaust outlets.

Preferably, the exhaust outlets are positioned rearward of the water intake opening in the hull. In a particularly preferred embodiment one of the two outlets is located on each side of the hull's center longitudinal axis. Additionally, the exhaust outlets preferably are substantially equidistant from the hull's center longitudinal axis.

In an additional embodiment the exhaust outlet has a generally elongated shape, the elongated outlet being angled with respect to the hull's center longitudinal axis from about 10° to about 35° and more preferably from about 15° to about 20°.

DETAILED DESCRIPTION OF THE PREFERRED EMBODIMENT

Figure 1:
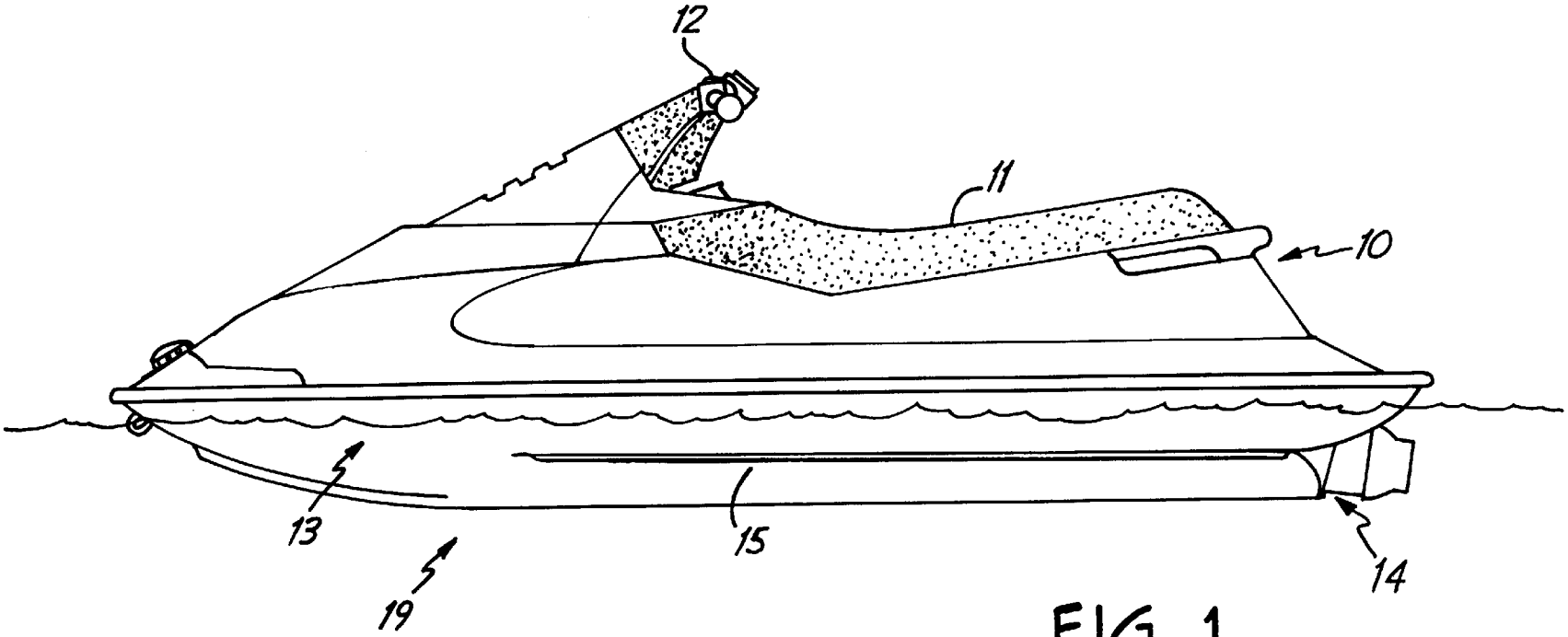
FIG. 1 is a side view of one embodiment of a personal watercraft of the present invention.

As shown in FIG. 1, a typical personal watercraft 10 provides a straddle-type seat 11, a pair of handle bars 12 for steering the watercraft, a hull 13, and a jet-pump propulsion drive unit 14. A large number of variations, both in materials and designs, are well known in the art for each of these components, and need not be described in detail.

Of particular interest are the presence of one or more strakes 15. Generally, these strakes 15 are present in pairs with one strake of each pair being placed on each side of the hull 13. The two strakes 15 of a given strake pair are generally equidistant from the hull's 13 bottom center longitudinal axis 25. The strakes 15 generally begin in the front portion of the hull 13 and extend to the rearward end of the hull 13. The strakes 15 provide lift and stability to the watercraft 10 during forward movement and particularly add stability when turning.

As previously discussed, despite the advantages of discharging exhaust gases into the surrounding body of water 19, there have been problems positioning the point of exhaust release along the bottom of the hull 13. Positioning the exhaust release too far forward on the hull 13 results in the release of exhaust into the jet-pump propulsion drive water intake. It is equally disadvantageous to locate the exhaust outlet too far rearward because this does not allow the exhaust sufficient time in the water for maximum cooling (and, therefore, noise reduction). An additional challenge is that downward facing exhaust outlets have proven to cause high back pressures which reduce engine efficiency.

Figure 2:
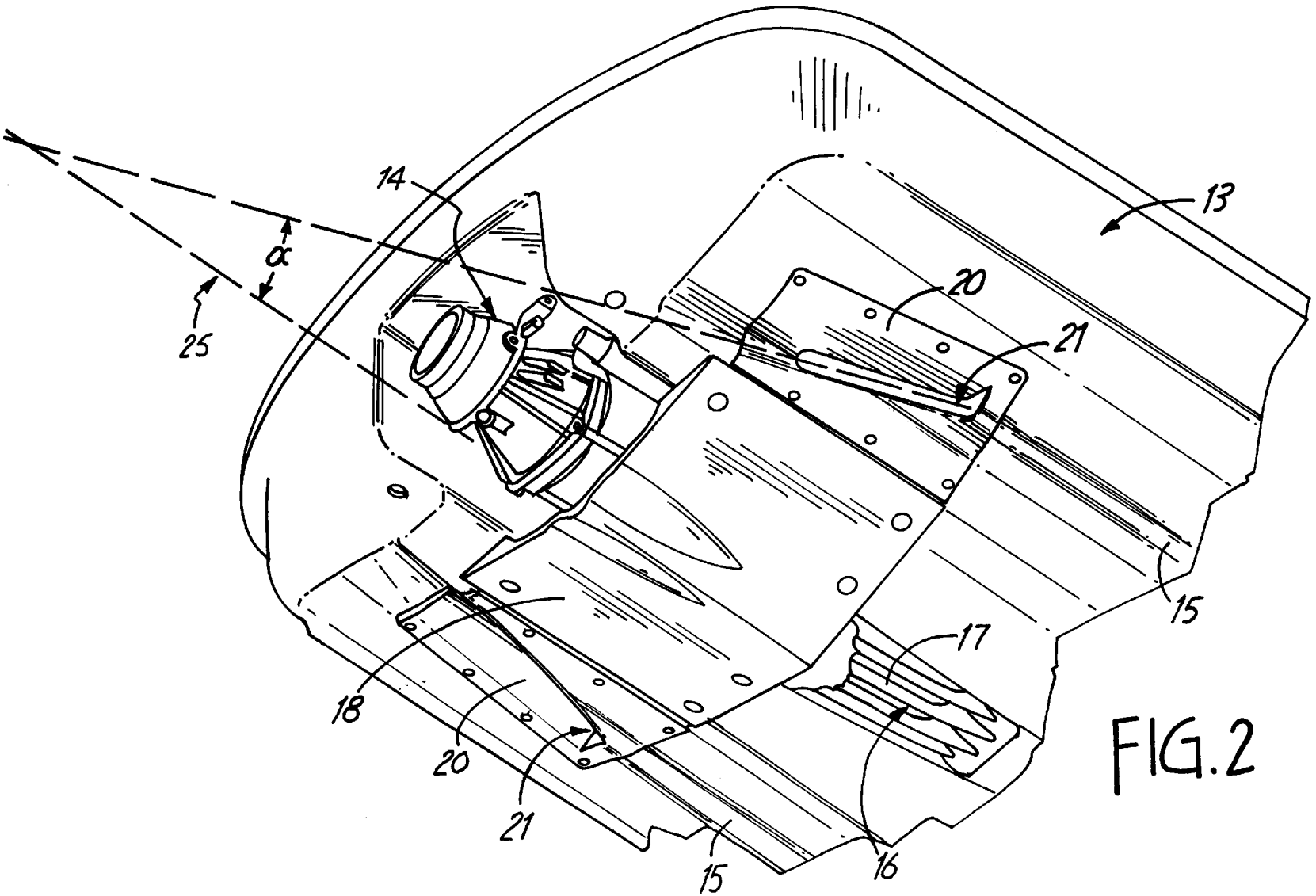
FIG. 2 is a bottom view of the rearward portion of one embodiment of a personal watercraft of the present invention.

As shown in FIG. 2, these problems have been resolved in the present invention by providing one or more exhaust outlet plates 20, each defining a generally rearward facing exhaust outlet 21, positioned along prematurely terminated strakes 15. The rearward facing outlet reduces the back pressure caused by traditional underwater exhaust outlets, while its location adjoining the end of a hull strake 15 provides for the creation of a low pressure area behind the strake 15 and in the exhaust outlet 21 during normal operation. The outlet plate 20 may be integrally formed within the hull 13 or it may be separately formed and attached thereto.

In a preferred embodiment of the invention, there are an even number of exhaust outlets 21 which are positioned on opposing sides of the hull 13 substantially equidistant from a bottom center longitudinal axis 25. The purpose of this design feature is to keep the system symmetrical, thereby preventing any directional bias which may be created by the presence of exhaust outlets on only one side of the hull 13.

More preferably, one exhaust outlet 21 is positioned on each side of the hull 13. In a preferred embodiment, at least one exhaust outlet 21 is positioned in the rearward end of a strake 15.

Another important determination in the positioning of the exhaust outlets 21 is how far forward the exhaust outlets may be placed along the hull 13. Here the presence of the jet propulsion drive unit 14 plays an important role. Generally, the drive 14 is located in a recessed portion of the hull 13 and is commonly covered with a ride plate 18. The drive 14 propels the watercraft forward by the intake of water in its forward end and the rapid expulsion of the water out its rearward end. Often the water intake opening 16 is protected by grill work 17. This grillwork 17 prevents the intake of debris from the surrounding water 19.

Positioning of the exhaust outlets 21 substantially forward of water intake 16 may result in the intake of exhaust gases which adversely affects propulsion efficiency. Therefore, it is desirable to locate the exhaust outlets 21 as far forward along the hull 13 as possible while remaining rearward of the intake opening 16. As shown in both FIGS. 2 and 3, the exhaust outlet 21 may have a generally elongated shape which is angled with respect to the longitudinal axis 25 (angle $\alpha$ of FIG. 2). This assists in the optimal delivery of exhaust gases into the surrounding body of water 19. While the optimal angle $\alpha$ may vary depending on hull design and watercraft speed, it is generally desirable for the elongated outlet to lie perpendicular to the direction of water-flow away from the hull at the position of the outlet when the watercraft is proceeding at normal operating speeds. The range of preferred values for $\alpha$ are from about 10° to about 35° and more preferably from about 15° to about 20°.

Figure 3:
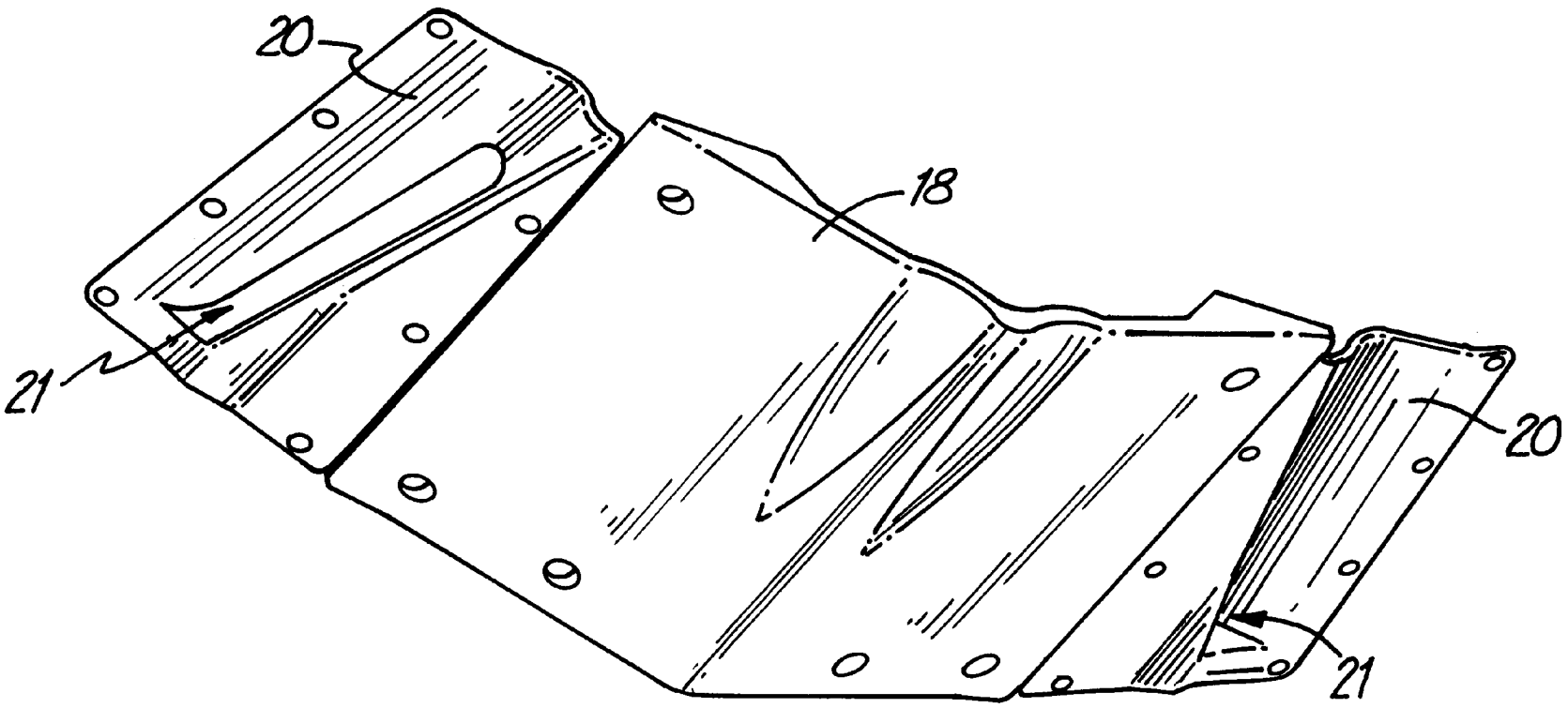
FIG. 3 is a bottom view of one embodiment of the ride plate and exhaust outlets of the present invention.

FIG. 3 also shows the opposite orientation of exhaust outlet plates 20, exhaust outlets 21 and ride plate 18. The preferred elongated exhaust outlets 21 are readily seen from this perspective.

The positioning of the exhaust outlet 21 laterally along the bottom of the hull 13 is affected by several considerations. First, it is preferable to place it along a strake 15 which is already present in a previously designed hull 13. However, it may be necessary to reposition a strake 15 to maximize the amount of time that the exhaust outlets remain under the surface of the water 19 during normal operation. The outlets 21 must also be positioned sufficiently spaced from the center longitudinal axis 25 so as to not interfere with the propulsion drive 14, its recess, and its associated components.

Figure 4:
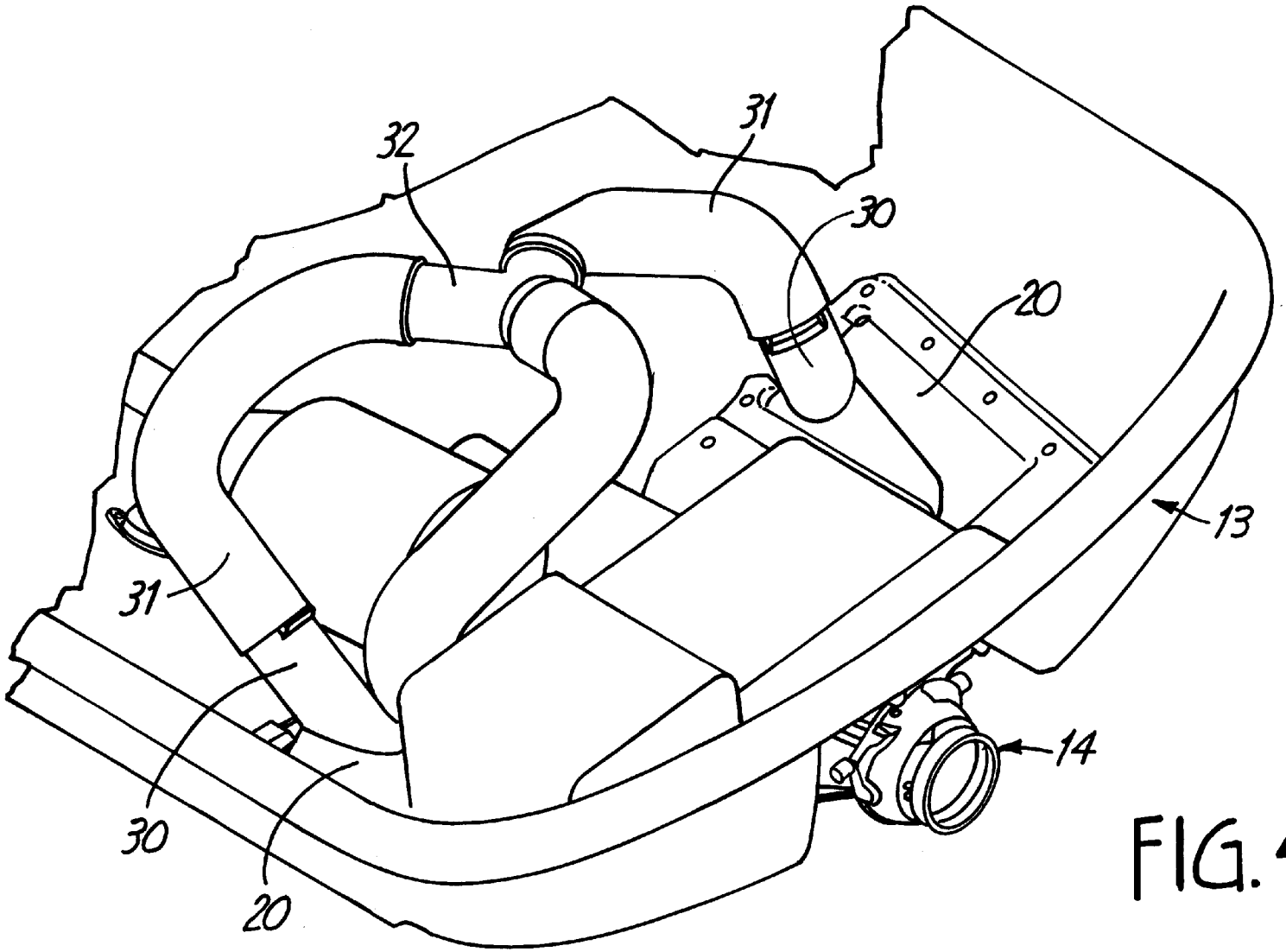
FIG. 4 is an internal view of the rearward portion of one embodiment of a personal watercraft of the present invention.

FIG. 4 shows an internal portion of the watercraft 13. Here one can see the exhaust outlet hose connector 30 which can be either an integral part of the exhaust outlet plate 20 or attached thereto. This connector 30 is used to attach exhaust hosing 31 providing fluid communication through the exhaust system from the exhaust outlet of the internal combustion engine to the exhaust outlets 21. A number of well known components may be included in this exhaust system, including exhaust manifolds, expansion chambers, silencers, and water traps. In those embodiments where more than one exhaust outlet is present, the exhaust hose desirably is evenly divided by the use of a Y-type or other acceptable adapter 32.

In some cases it may be desirable to have an exhaust system where a single exhaust path lies between the exhaust manifold and the adapter 32. This would include a single expansion chamber, one or more silencers, and optionally a water trap in serial connection between the manifold and the adapter 32.

While a preferred embodiment of the present invention has been described, it should be understood that various changes, adaptations and modifications may be made therein without departing from the spirit of the invention and the scope of the appended claims.

What is claimed is:

1. A personal watercraft comprising, a hull having a plurality of longitudinally extending strakes, an inboard internal combustion engine which powers a propulsion drive for propelling the hull through a body of water, and an exhaust system that is in fluid communication with the engine, the exhaust system terminating at one or more rearwardly facing exhaust outlets, each exhaust outlet being positioned along the hull below the body of water's surface when the hull is in its normal upright position and each also adjoining one of the strakes' rearward end.

2. The watercraft of claim 1 wherein there are two exhaust outlets.

3. The watercraft of claim 2 wherein the hull defines a water intake opening for the propulsion drive and where the exhaust outlets are positioned rearward of the water intake opening.

4. The watercraft of claim 1 wherein the hull defines a water intake opening for the propulsion drive and where the one or more exhaust outlets are positioned rearward of the water intake opening.

5. The watercraft of claim 4 wherein there are an even number of exhaust outlets, the hull has a center longitudinal axis, equal numbers of the outlets being located on each side of the longitudinal axis and where the exhaust outlets are substantially equidistant from the longitudinal axis.

6. The watercraft of claim 2 wherein the hull has a center longitudinal axis, the outlets being located on opposite sides of the longitudinal axis, the exhaust outlets being substantially equidistant from the longitudinal axis.

7. A personal watercraft comprising, a hull having a plurality of strakes, an inboard internal combustion engine which powers a jet-pump for propelling the hull through a body of water, a straddle-type seat disposed above the engine, handlebars, a water intake opening for the jet-pump defined by the hull, the hull having a center longitudinal axis, and an exhaust system that is in fluid communication with the engine; where the exhaust system terminates at two rearwardly facing exhaust outlets which are each positioned along the hull below the body of water's surface when the hull is in its upright position, each outlet being positioned rearward of the water intake opening and adjoining one of the strakes' rearward end, one of the outlets being located on one side of the longitudinal axis, the other one of the outlets being located on the other side of the longitudinal axis, and the exhaust outlets being substantially equidistant from the longitudinal axis.

8. The watercraft of claim 7 wherein each exhaust outlet has a generally elongated shape, each elongated outlet being angled with respect to the hull's center longitudinal axis from about 10° to about 35°.

9. The watercraft of claim 7 wherein each exhaust outlet has a generally elongated shape, each elongated outlet being angled with respect to the hull's center longitudinal axis from about 15° to about 20°.

* * * * *